US005507564A

United States Patent [19]

Huang

[11] Patent Number: 5,507,564

[45] Date of Patent: Apr. 16, 1996

[54] BABY DECK CHAIR HAVING AN ADJUSTABLE BACK

[76] Inventor: Li-chu C. Huang, No. 9, Alley 2, Lane 606, Sec. 2, Po Ai Rd., Chia Yi City, Taiwan

[21] Appl. No.: 492,292

[22] Filed: Jun. 19, 1995

[51] Int. Cl.[6] ..... A47D 1/00

[52] U.S. Cl. ..... 297/452.13; 297/DIG. 11; 297/256.13; 297/369

[58] Field of Search ..... 297/DIG. 11, 452.13, 297/256.13, 369, 183.3, 183.6

[56] References Cited

U.S. PATENT DOCUMENTS

| | | | |
|---|---|---|---|
| 4,516,806 | 5/1985 | McDonald et al. | 297/452.13 |
| 4,553,786 | 11/1985 | Lockett, III et al. | 297/452.13 X |
| 4,998,307 | 3/1991 | Cone | 297/256.13 X |
| 5,207,478 | 5/1993 | Freese et al. | 297/452.13 X |
| 5,451,095 | 9/1995 | Riback | 297/452.13 X |
| 5,460,430 | 10/1995 | Miga, Jr. et al. | 297/452.13 |

FOREIGN PATENT DOCUMENTS

| | | | |
|---|---|---|---|
| 4000157 | 8/1985 | Netherlands | 297/361.1 |

*Primary Examiner*—Peter M. Cuomo
*Assistant Examiner*—David E. Allred
*Attorney, Agent, or Firm*—Gunn, Lee & Miller

[57] ABSTRACT

A baby deck chair having an adjustable back wherein the back has two distal ends each of which is inserted to a corresponding socket which is pivotally engaged to a block and the block is connected to a base, an extending portion connected between the two sockets opposite to the back, the block having a plurality of notches defined in an outer periphery thereof and a button pivotally engaged to the socket and received in a slot defined in the socket, a tongue extending from an inner portion of the socket and corresponding to the slot such that a spring is disposed between the button and the tongue, the button having a protrusion extending downward from an end thereof for engagement with one of the notches to adjust an angle of the back corresponding to the ground.

3 Claims, 8 Drawing Sheets

BABY DECK CHAIR HAVING AN ADJUSTABLE BACK

BACKGROUND OF THE INVENTION

1. Field of the Invention

The present invention relates to a baby deck chair and more particularly, to a baby deck chair which back can be adjusted to positions with different angles corresponding to the ground.

2. Related Prior Art

A baby deck chair is designed for a baby lay therein, which is shown in FIG. 1 and has a back 60, a base 70 and an extending portion 80 extending from the back 60, the back 60 and the extending portion 80 are constructed by metal rods over which a fabric or sponge are disposed in order to provide a comfortable condition. The back 60 is fixedly connected to the base 70 at a top part of the base 70 which has a frame 71 extending therefrom to support the chair such that the back 60 has a distal end so it can be swung at a limited range about the connecting portion of the back 60 and the base 70, i.e., the back 60 has a function as a cantilever resilient element, therefore, an operator pushes the back 60 downward and then off his/her hand the back 60 is swung. However, the mentioned baby deck chair cannot be folded and occupies too much space, furthermore, the back 60 of the mentioned baby deck chair has a fixed angle corresponding to the ground, that is, no matter the baby is awake or the baby is sleeping, the baby can only be lain in the back at a fixed angle, this cannot meet the different needs of the baby when he/she is awake and is asleep.

The present invention intends to provide a baby deck chair of which the back can be adjusted to angles corresponding to the ground to mitigate and/or obviate the above-mentioned problems.

SUMMARY OF THE INVENTION

The present invention provides a baby deck chair having an adjustable back wherein the back has two distal ends each of which is inserted to a responding socket which is pivotally engaged to a block and the block is connected to a base, an extending portion connected between the two sockets, the block having a plurality of notches defined in an outer periphery thereof and a button pivotally engaged to the socket and received in a slot defined in the socket, a tongue extending from an inner portion of the socket and corresponding to the slot such that a spring is disposed between the button and the tongue, the button having a protrusion extending downward from an end thereof for engagement with one of the notches to adjust an angle of the back corresponding to the ground.

It is an object of the present invention to provide a baby deck chair which back can be adjusted to different angles corresponding to the ground.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
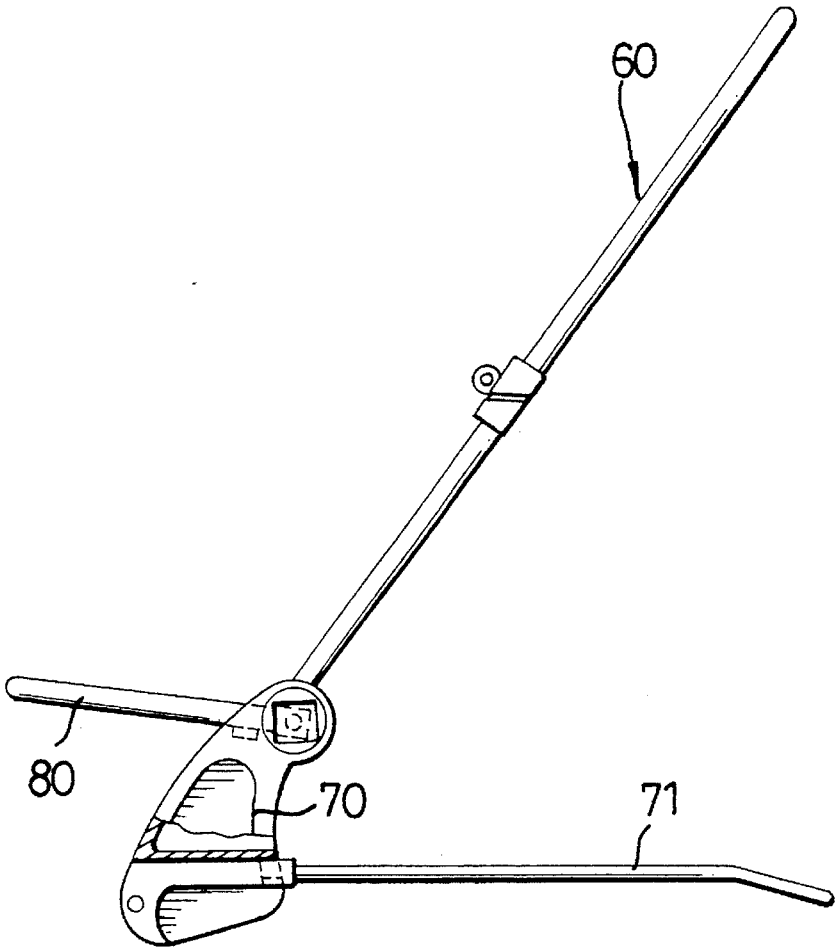
FIG. 1 PRIOR ART
FIG. 1 is a side elevational view, partly in section, of a conventional baby deck chair.
Figure 2:
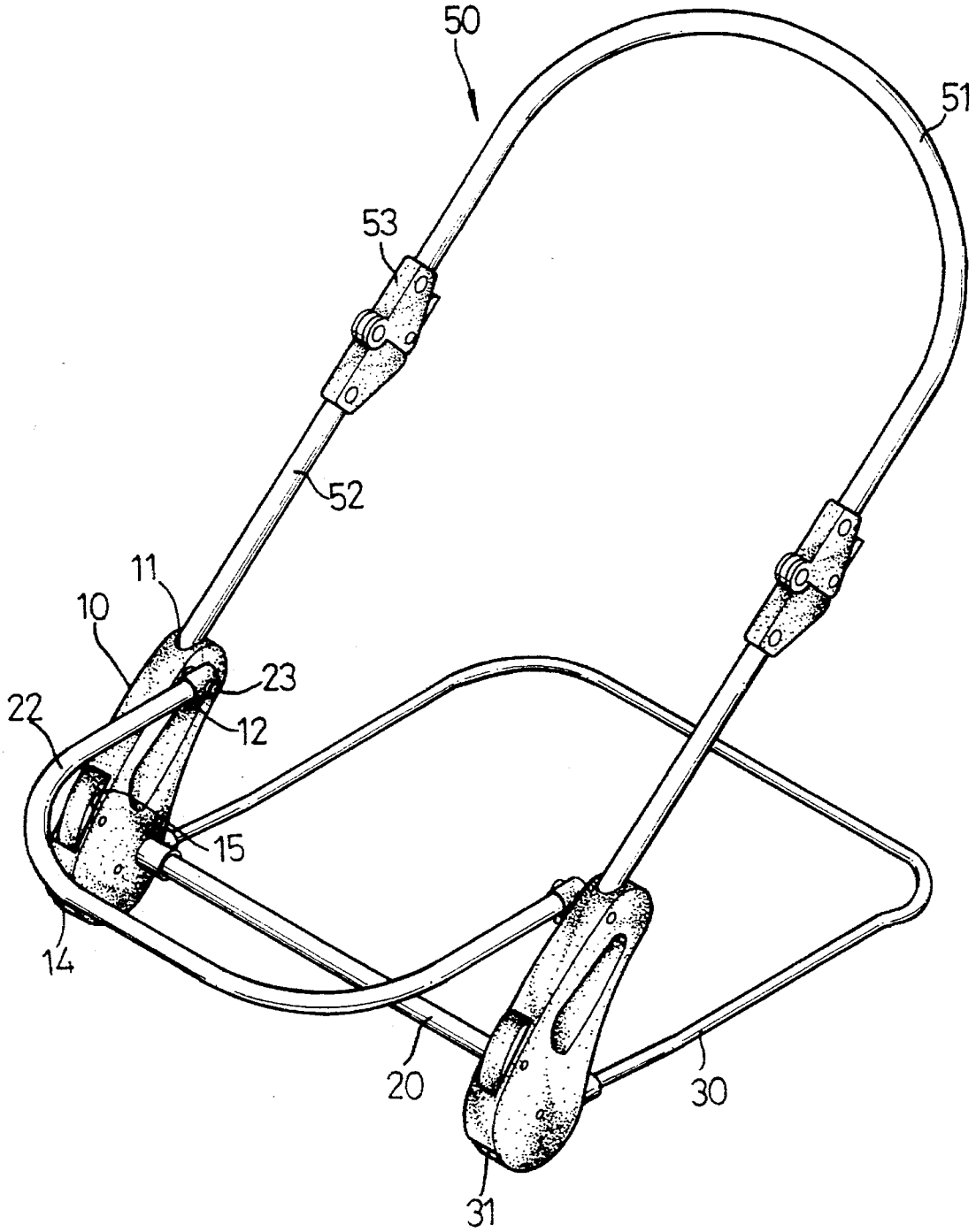
FIG. 2 is a perspective view of a baby deck chair in accordance with the present invention.
Figure 3:
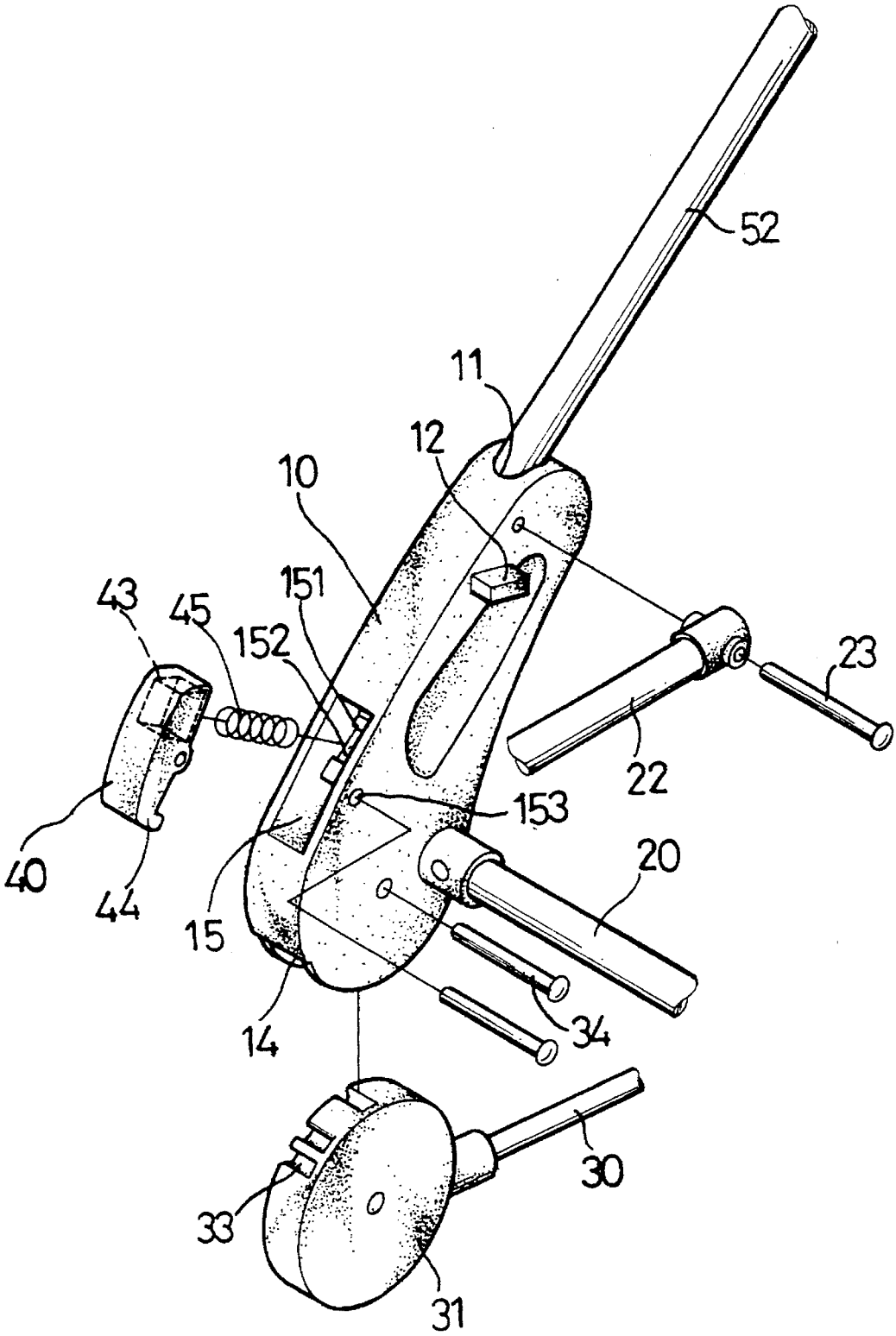
FIG. 3 is an exploded view of a socket to which the back, the base and the extending portion connect in accordance with the present invention.
Figure 4:
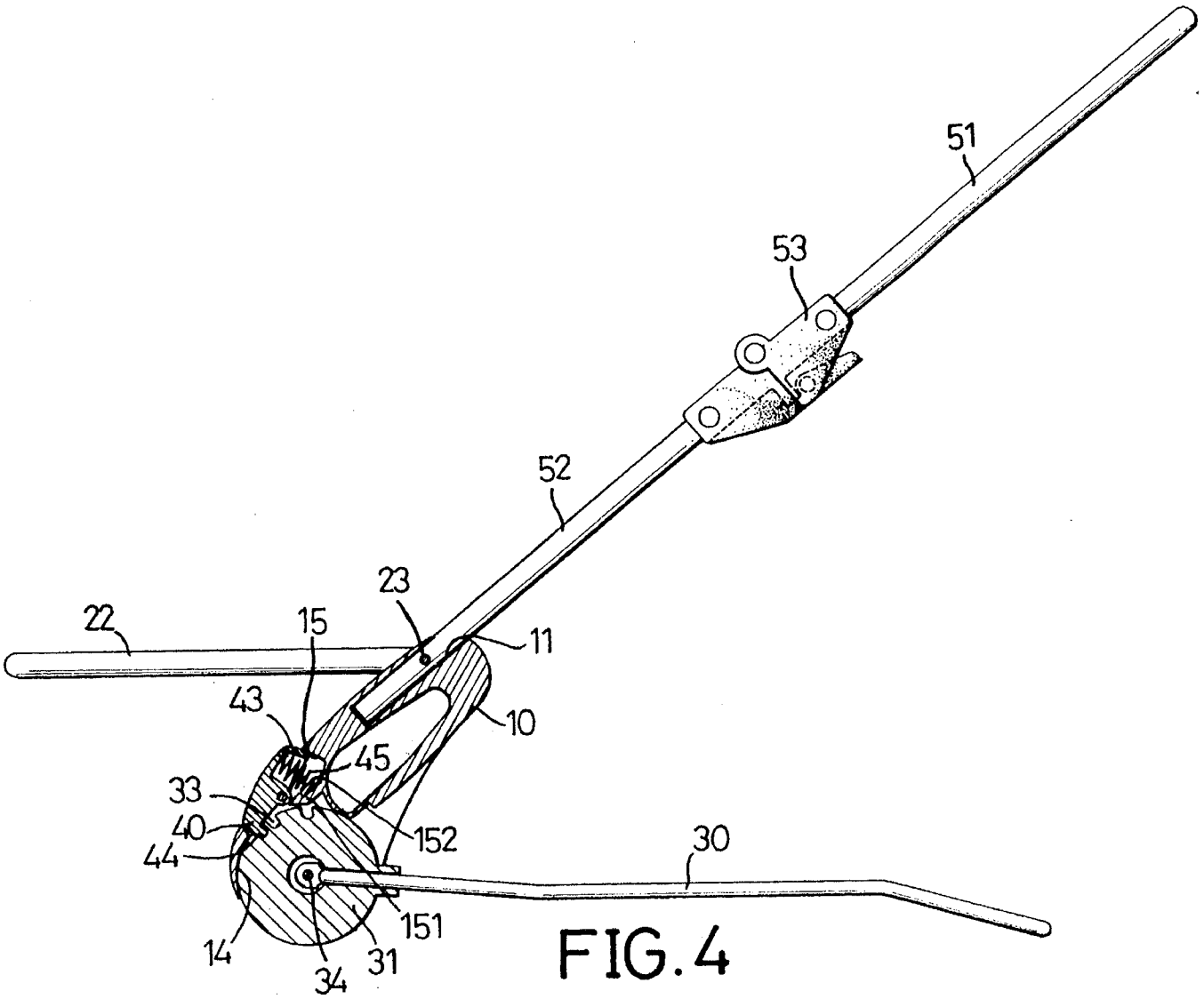
FIG. 4 is a side elevational view, partly in section, of the engagement of the socket, the back, the base and the extending portion in accordance with the present invention.
Figure 8:
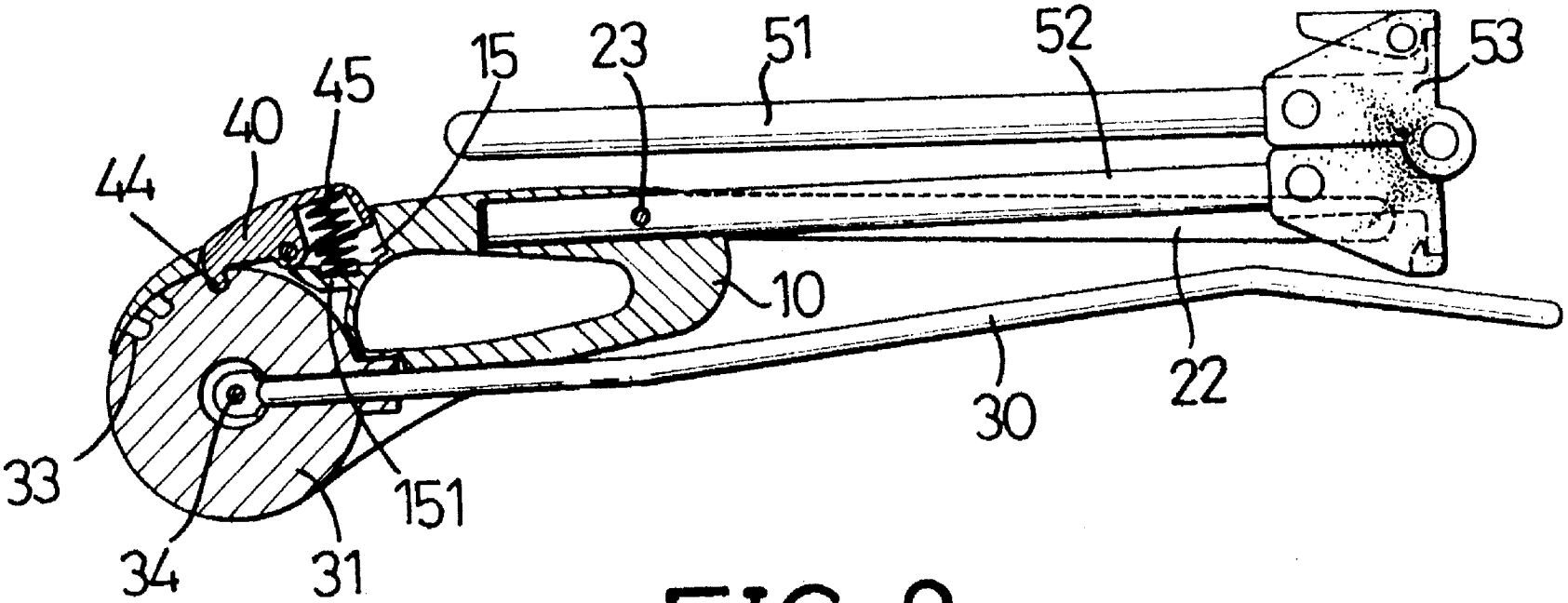
FIG. 8 is a side elevational view, partly in section, of the baby deck chair wherein the back, the extending portion are adjusted and folded to parallel with each other.

Referring to the drawings and initially to FIGS. 2 through 4, a baby deck chair having an adjustable back in accordance with the present invention generally includes a back 50, two sockets 10, a base 30 and an extending portion 22, the back 50 comprises a first part 51 and a second part, the first part 51 being a U-shaped configuration and having two distal ends (not shown), each of the distal end pivotally engaged to one end of a connecting element 53, the second part including two rods 52 each of the rods 52 having one end thereof inserted into the corresponding socket 110 and the other end thereof pivotally connected to the other end of the connecting element 53 such that the first part 51 and the rods 52 can be folded to be disposed parallel with each other as shown in FIG. 8.

Each of the sockets 10 has two opposite walls and has a first hole 11 defined in a top thereof for the corresponding distal end of the rod 52 inserted therein and a second hole 14 defined in a bottom thereof. A slot 15 is defined in an upper front surface of the socket 10 and communicates with the second hole 14, a tongue 151 connected between the two opposite walls and extending between the slot 15 and the second hole 14, a first recess 152 defined in the tongue 151. The extending portion 22 has a U-shaped configuration and connected between the two sockets 10 by a pin 23 extending through the extending portion 22, the socket 10 and the distal end of the rod 52. Each of the sockets 10 has a stop 12 extending from an inner side thereof, the extending portion 22 being supported thereby.

The base 30 has a U-shaped configuration and has two distal ends, each of the distal ends having a block 31 which is received in the socket 10 from the second hole 14 by extending a pin 34 through the socket 10 and the block 31 and the block 31 having a plurality of notches 33 defined in an outer periphery thereof.

A button 40 is pivotally engaged between the two opposite walls and is received in the slot 15 of the socket 10 and has a first end and a second end, the first end thereof having a protrusion 44 extending downwardly therefrom for selectable engagement with one of the notches 33 and the second end thereof having a second recess 43 defined in a bottom thereof corresponding to the first recess 152 of the tongue 151 for a spring 45 disposed between the first recess 152 and the second recess 43 such that the protrusion 44 is biased to be engaged with the corresponding notch 33 of the block 31 to position the back 50 an angle corresponding to the ground.

Figure 5:
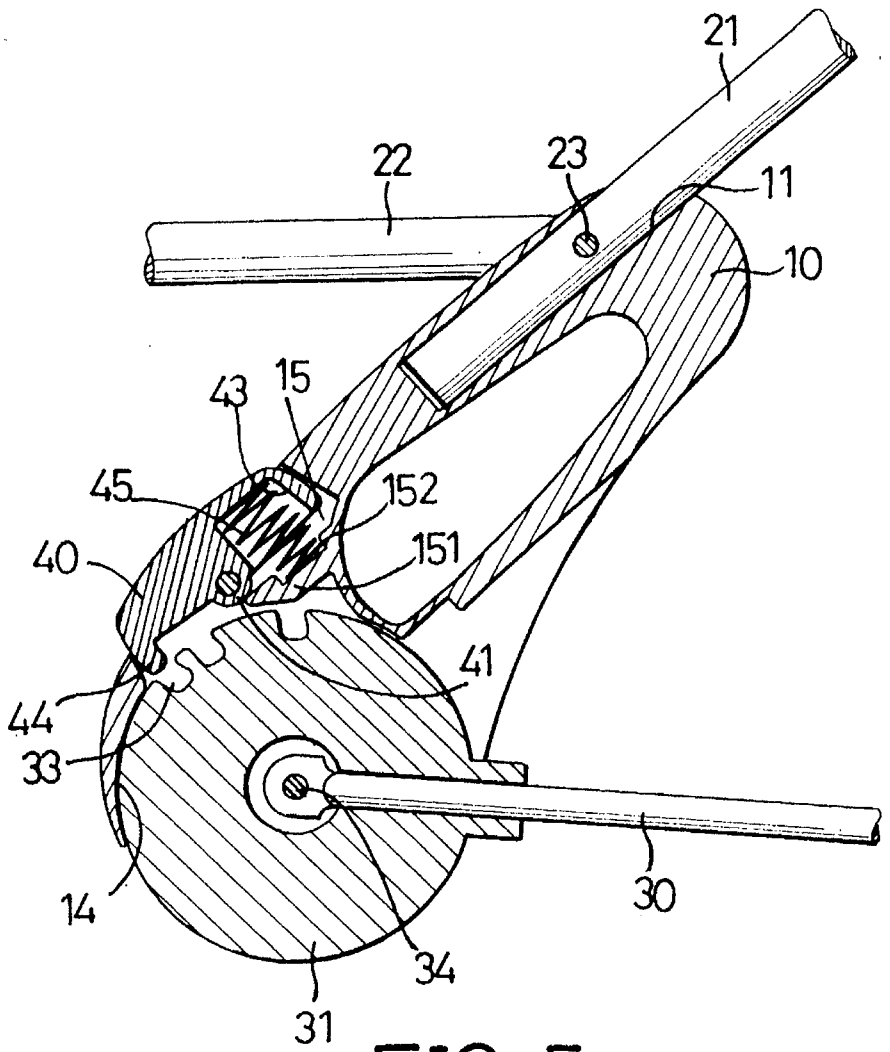
FIG. 5 is a view similar to FIG. 3 wherein a button is disengaged from a block of the base.
Figure 6:
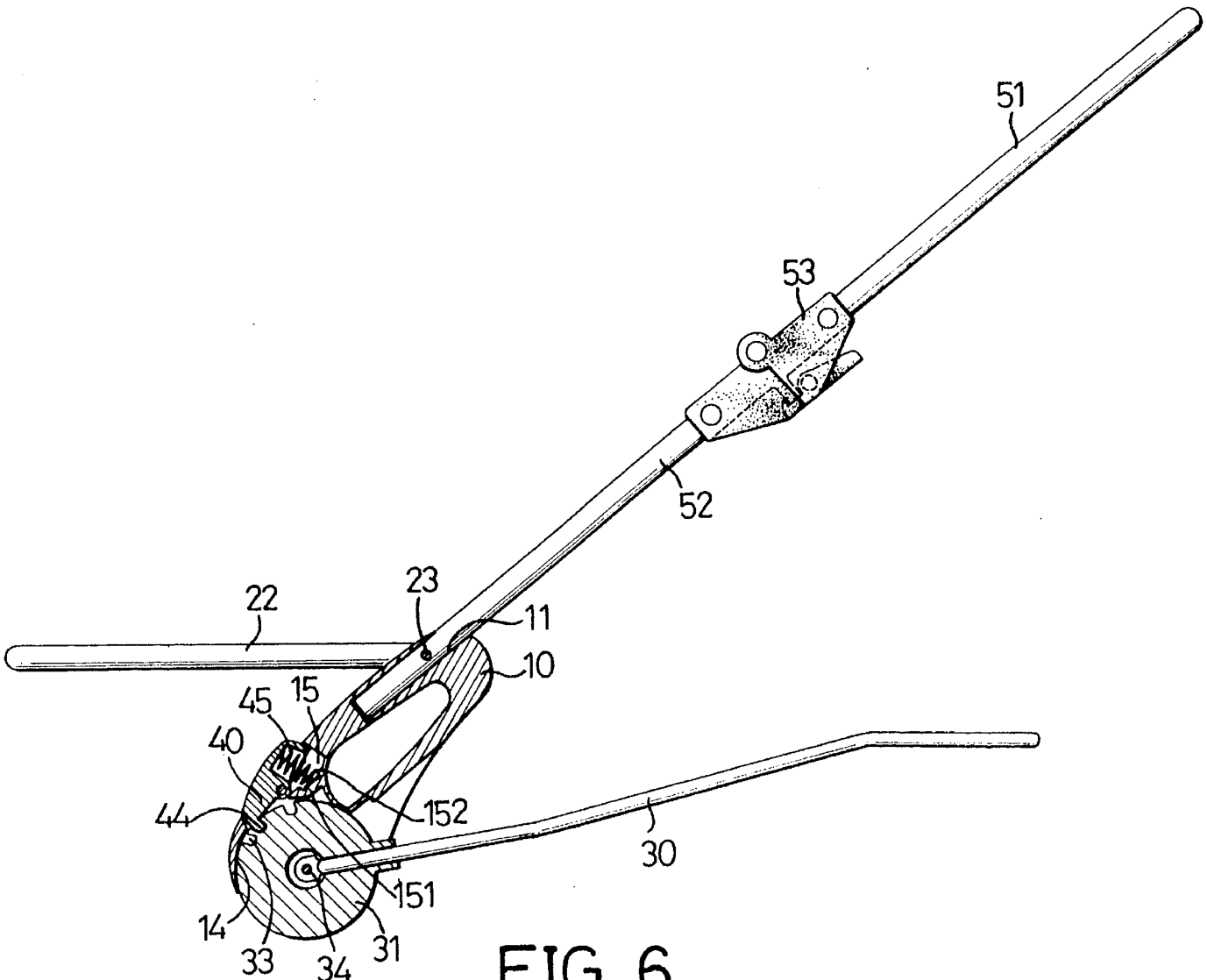
FIG. 6 is a view similar to FIG. 3 wherein a protrusion of the button is engaged with a notch of the block of the base.
Figure 7:
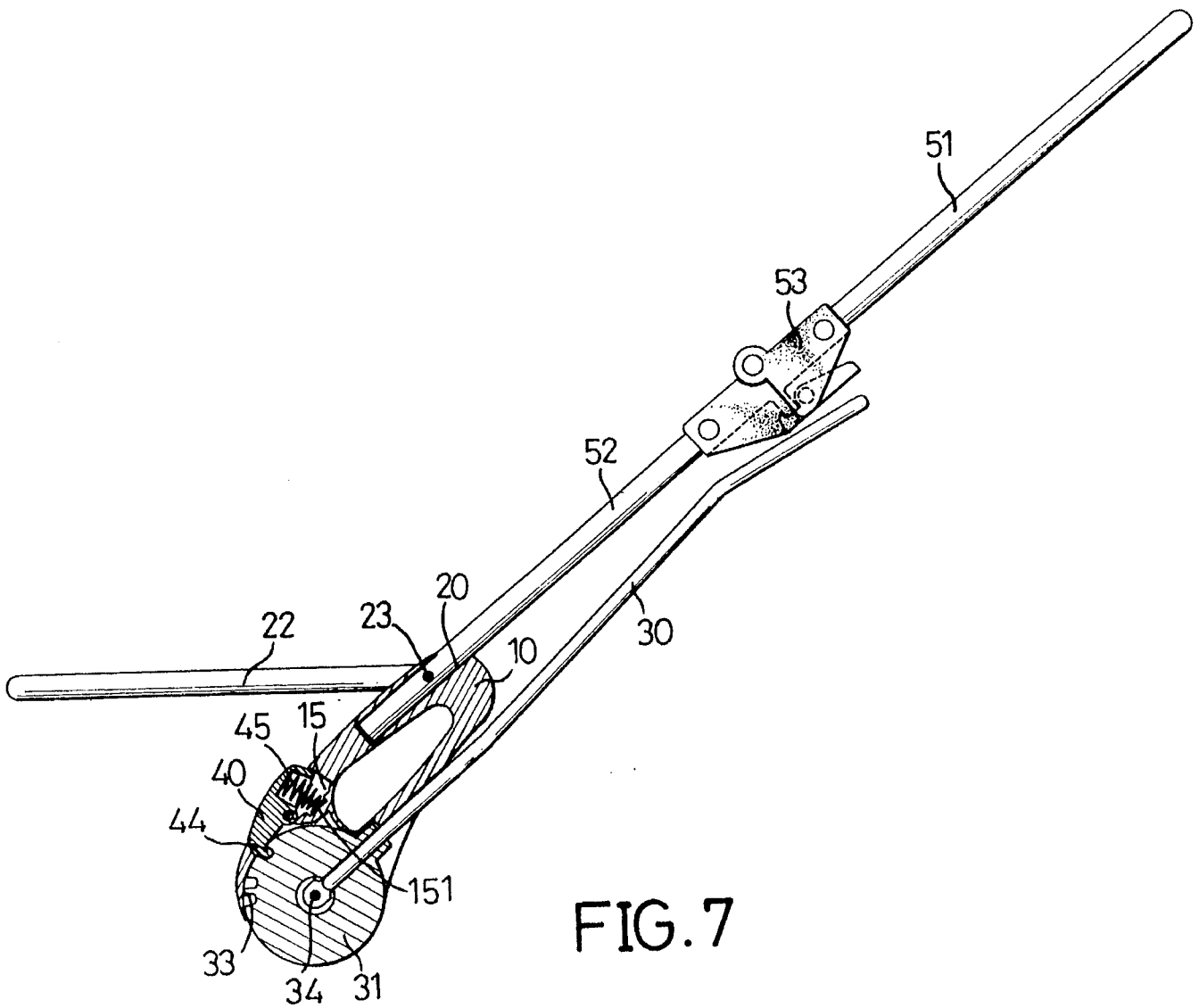
FIG. 7 is a view similar to FIG. 3 wherein the back is adjusted to be disposed parallel to the base.

Referring now to FIGS. 5 and 6, when adjusting the back 50, an operator pushes the button 40 to lift the protrusion 44 out from the notch 33 and rotates the back 50 about the pin 34 of the block 31 to engage the protrusion 44 with another notch 33 to fix the back 50 in a new position. FIGS. 7 and 8 show the back 50 and the base 30 are adjusted to be disposed parallel with each other when the protrusion 44 of the button 40 is engaged with an inner-most notch 33, the extending portion 22 can be rotated about the pin 23 to position the extending portion 22 onto the back 50 and the first part 51 of the back 50 can be rotated about the connecting element 53 so as to be disposed onto the two rods 52 such that the baby deck chair can be folded to occupy a less space.

Although the invention has been explained in relation to its preferred embodiment, it is to be understood that many other possible modifications and variations can be made without departing from the spirit and scope of the invention as hereinafter claimed.

I claim:

1. A baby deck chair having an adjustable back, comprising:

a back, said back being a U-shaped configuration and having two distal ends;

two sockets, each of said sockets having two opposite walls, and having a first hole defined in a top thereof for said corresponding distal end of said back inserted therein and a second hole defined in a bottom thereof, a slot defined in an upper front surface of each of said sockets and communicating with said second hole and a tongue extending between said slot and said second hole, a first recess defined in said tongue;

a base being a U-shaped configuration and having two distal ends, each of said distal ends having a block rotatably received respectively in each of said sockets from said second hole, said block having a plurality of notches defined in an outer periphery thereof;

an extending portion being a U-shaped configuration and connected between said two sockets, and a button pivotally engaged between said two opposite walls and received in said slot of each of said sockets and having a first end and a second end, said first end thereof having a protrusion extending downwardly therefrom for selectable engagement with one of said notches and said second end thereof having a second recess defined in a bottom thereof corresponding to said first recess of said tongue for receiving a spring disposed between said first recess and said second recess.

2. The baby deck chair as claimed in claim 1 wherein each of said sockets has a stop extending from an inner side thereof, said extending portion being supported thereby.

3. The baby deck chair as claimed in claim 1 wherein said back comprises a first part and a second part, said first part being a U-shaped configuration and having two distal ends, each of said distal ends pivotally engaged to a connecting element, said second part including two rods each of said rods having one end thereof inserted into said corresponding socket and the other end thereof pivotally connected to said connecting element such that said first part is folded corresponding to said two rods.

* * * * *